US009847613B2

(12) United States Patent
Kondo et al.

(10) Patent No.: US 9,847,613 B2
(45) Date of Patent: Dec. 19, 2017

(54) CONNECTOR AND CONTACT

(71) Applicant: FUJITSU COMPONENT LIMITED, Tokyo (JP)

(72) Inventors: Takahiro Kondo, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/461,642

(22) Filed: Mar. 17, 2017

(65) Prior Publication Data

US 2017/0187153 A1 Jun. 29, 2017

Related U.S. Application Data

(62) Division of application No. 14/693,237, filed on Apr. 22, 2015, now Pat. No. 9,634,443.

(30) Foreign Application Priority Data

Apr. 24, 2014 (JP) ..... 2014-090558

(51) Int. Cl.

| | |
|---|---|
| ***H01R 12/00*** | (2006.01) |
| ***H01R 24/44*** | (2011.01) |
| ***H01R 12/53*** | (2011.01) |
| ***H01R 12/57*** | (2011.01) |
| *H01R 107/00* | (2006.01) |
| *H01R 103/00* | (2006.01) |

(52) U.S. Cl.

CPC ..... *H01R 24/44* (2013.01); *H01R 12/53* (2013.01); *H01R 12/57* (2013.01); *H01R 2103/00* (2013.01); *H01R 2107/00* (2013.01)

(58) Field of Classification Search

CPC .... H01R 2103/00; H01R 24/50; H01R 24/52; H01R 9/096; H01R 23/722; H01R 23/6886; H01R 23/6873

USPC ..... 439/63, 65, 108, 74, 581

See application file for complete search history.

(56) References Cited

U.S. PATENT DOCUMENTS

| | | | | |
|---|---|---|---|---|
| 5,194,020 | A * | 3/1993 | Voltz | H01R 13/514 439/540.1 |
| 5,863,220 | A | 1/1999 | Holliday | |
| 6,238,218 | B1 | 5/2001 | Baffert | |

(Continued)

FOREIGN PATENT DOCUMENTS

| | | |
|---|---|---|
| EP | 1054479 | 11/2000 |
| FR | 2598856 | 11/1987 |
| JP | 2009-129863 | 6/2009 |

*Primary Examiner* — Hien Vu

(74) *Attorney, Agent, or Firm* — IPUSA, PLLC

(57) ABSTRACT

A connector includes a housing attached to a board; a ground terminal including a ground base disposed in the housing, and a first ground connection part extending from the ground base toward a first end of the housing and to be connected to a ground line of a coaxial cable; and a signal terminal including a signal base that is held in the housing and surrounded by the ground base while being insulated from the ground base, and a first signal connection part extending from the signal base toward the first end of the housing and to be connected to a signal line of the coaxial cable. The ground terminal and the signal terminal are configured to elastically bend at a second end of the housing when the housing is attached to the board.

3 Claims, 18 Drawing Sheets

(56) References Cited

U.S. PATENT DOCUMENTS

| | | | | |
|---|---|---|---|---|
| 6,468,089 | B1 * | 10/2002 | Hubbard | H01R 23/6873 439/328 |
| 7,125,264 | B2 | 10/2006 | Murayama et al. | |
| 7,179,127 | B2 | 2/2007 | Shiu | |
| 7,695,289 | B1 | 4/2010 | Sato et al. | |
| 7,909,613 | B2 * | 3/2011 | Lee | H01R 9/0515 439/63 |
| 7,980,893 | B2 | 7/2011 | Sato et al. | |

* cited by examiner

CONNECTOR AND CONTACT

CROSS-REFERENCE TO RELATED APPLICATION

The present application is a divisional application of U.S. patent application Ser. No. 14/693,237 filed on Apr. 22, 2015 and is based upon and claims the benefit of priority of Japanese Patent Application No. 2014-090558, filed on Apr. 24, 2014, the entire contents of which are incorporated herein by reference.

BACKGROUND OF THE INVENTION

1. Field of the Invention

An aspect of this disclosure relates to a connector and a contact.

2. Description of the Related Art

Japanese Laid-Open Patent Publication No. 2009-129863, for example, discloses a multipolar coaxial connector including a plug where multiple coaxial cables are bound together and a receptacle that is mounted on a board. The plug is connected to the receptacle by removably inserting the plug into the receptacle.

The plug includes a housing made of a resin and having an oblong fit hole in its front face in an insertion direction, and multiple pairs of signal terminal plates and GND terminal plates that are electrically connected to inner conductors and outer conductors of the corresponding coaxial cables. Each pair of the signal terminal plate and the GND terminal plate are disposed to face each other across the fit hole, and the multiple pairs of the signal terminal plates and the GND terminal plates are arranged in the length direction of the fit hole.

The receptacle includes an oblong columnar part that protrudes toward the plug and is to be inserted into the fit hole of the housing, and multiple pairs of signal spring terminals and GND spring terminals held on the columnar part. The pairs of the signal spring terminals and the GND spring terminals elastically contact the corresponding pairs of the signal terminal plates and the GND terminal plates from the side of the columnar part.

However, in the disclosed multipolar coaxial connector, the impedance of the signal terminal plates is not matched sufficiently with the impedance of the GND terminal plates. Therefore, with the disclosed multipolar coaxial connector, it may be difficult to transmit a signal in an impedance matched state.

SUMMARY OF THE INVENTION

In an aspect of this disclosure, there is provided a connector for connecting a signal line and a ground line formed on a board with a coaxial cable. The connector includes a housing to be attached to the board; a ground terminal including a ground base that is disposed in the housing, and a first ground connection part that extends from the ground base toward a first end of the housing and is to be connected to a ground line of the coaxial cable; and a signal terminal including a signal base that is held in the housing and is surrounded by the ground base while being insulated from the ground base, and a first signal connection part that extends from the signal base toward the first end of the housing and is to be connected to a signal line of the coaxial cable. The ground terminal and the signal terminal are configured to elastically bend at a second end of the housing when the housing is attached to the board and the ground terminal and the signal terminal are connected, respectively, to the ground line and the signal line of the board.

DESCRIPTION OF EMBODIMENTS

Embodiments of the present invention are described below with reference to the accompanying drawings.

First Embodiment

Figure 1A:
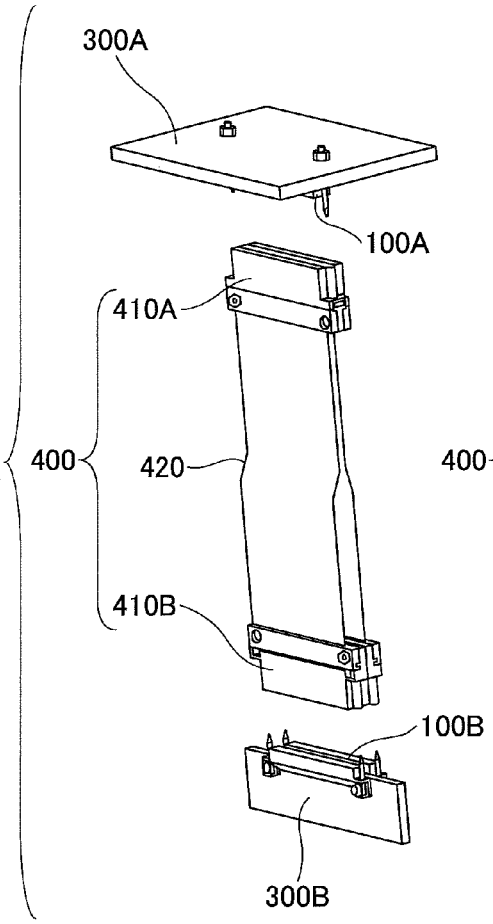
FIGS. 1A and 1B are drawings illustrating connectors according to a first embodiment.
Figure 1B:
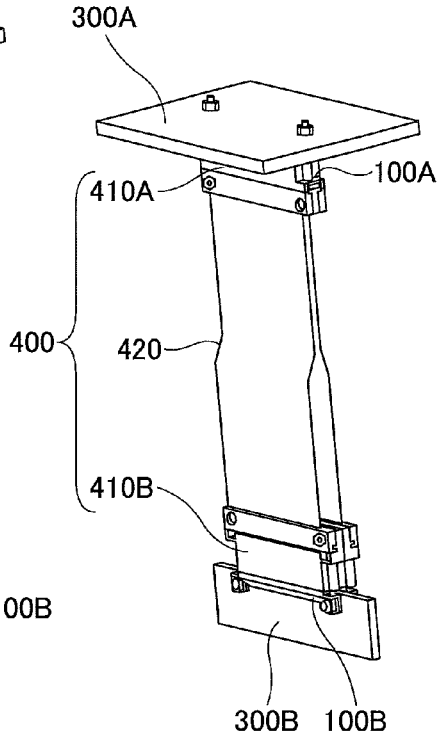

FIGS. 1A and 1B are drawings illustrating connectors 100A and 100B according to a first embodiment. As illustrated by FIG. 1A, the connector 100A is attached to a board 300A, and the connector 100B is attached to a board 300B.

Each of the boards 300A and 300B includes signal lines and ground lines. The characteristic impedance of the signal lines and the ground lines of the boards 300A and 300B is set at a predetermined value (e.g., 50Ω) to enable high-speed signal transmission at, for example, about 2.0 Gbps.

The signal lines and the ground lines of the boards 300A and 300B with such characteristic impedance may be implemented by microstrip lines or coplanar lines. The connector 100A is connected to the signal lines and the ground lines of the board 300A, and the connector 100B is connected to the signal lines and the ground lines of the board 300B.

A flexible printed circuit (FPC) assembly 400 includes connectors 410A and 410B and a pair of FPCs 420. Each of the FPCs 420 includes signal lines and ground lines.

The characteristic impedance of the signal lines and the ground lines of each FPC 420 is set at a predetermined value (e.g., 50Ω) to enable high-speed signal transmission at, for example, about 2.0 Gbps. The connector 410A is connected to first ends of the FPCs 420, and the connector 410B is connected to second ends of the FPCs 420.

In FIG. 1B, the connectors 410A and 410B of the FPC assembly 400 are connected to the corresponding connectors 100A and 100B.

Figure 2A:
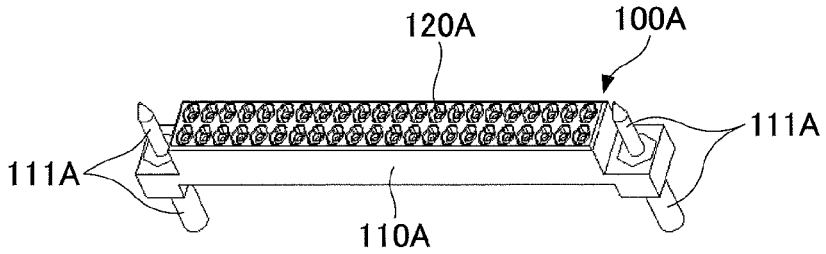
FIGS. 2A through 2D are drawings illustrating a connector according to the first embodiment.
Figure 2B:
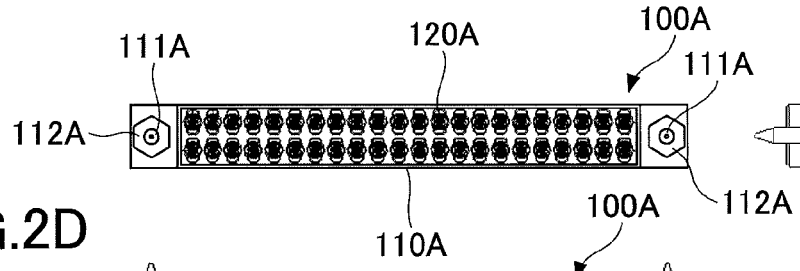
Figure 2C:
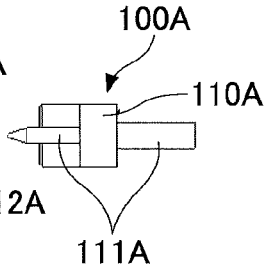
Figure 2D:
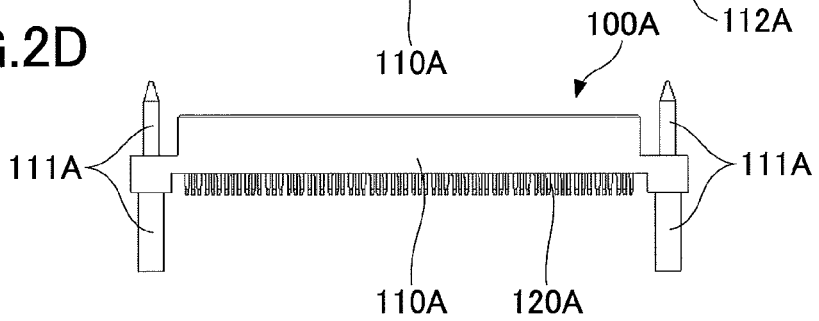

FIG. 2A is a perspective view, FIG. 2B is a front view, FIG. 2C is a side view, and FIG. 2D is a plan view of the connector 100A.

The connector 100A is formed by fitting forty-four contacts 120A into the corresponding through holes of a housing 110A. The connector 100A also includes guide pins 111A used when the housing 110A is attached to the board 300A (see FIG. 1). The guide pins 111A are screwed into nuts 112A embedded in the housing 110A.

Through holes corresponding to the guide pins 111A are formed in the board 300A. The guide pins 111A of the housing 110A are aligned with the through holes of the board 300A, and the connector 100A is attached to a surface of the board 300A by screwing the guide pins 111A into the through holes as illustrated in FIG. 1A. For example, the guide pins 111A may be comprised of a metal such as copper or nickel, or a resin.

The housing 110A may be comprised of an insulating material such as an epoxy resin. The housing 110A has a cuboid shape. Forty-four through holes for inserting forty-four contacts 120A are formed in the housing 110A.

Each contact 120A includes a first end and a second end, and extends in a direction that is substantially perpendicular to a surface of the board 300A (see FIGS. 1A and 1B). The contacts 120A may be comprised of, for example, a metal such as copper or nickel.

The first ends of the contacts 120A are illustrated in FIGS. 2A and 2B, and the second ends of the contacts 120A are illustrated in FIG. 2D. The first ends of the contacts 120A face a direction that is perpendicular to and away from a surface of the board 300A, and the second ends of the contacts 120A face an opposite direction, i.e., face the surface of the board 300A. The first ends of the contacts 120A are connected to the connector 410A of the FPC assembly 400, and the second ends of the contacts 120A are connected to the signal lines and the ground lines of the board 300A. In FIGS. 1A and 1B, the signal lines and the ground lines of the board 300A are omitted.

Figure 3A:
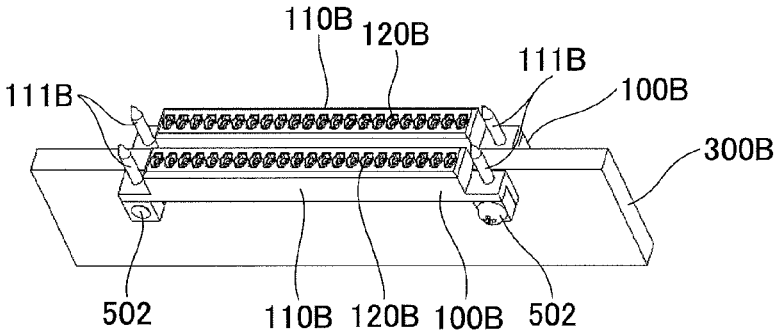
FIGS. 3A through 3E are drawings illustrating a connector according to the first embodiment.
Figure 3B:
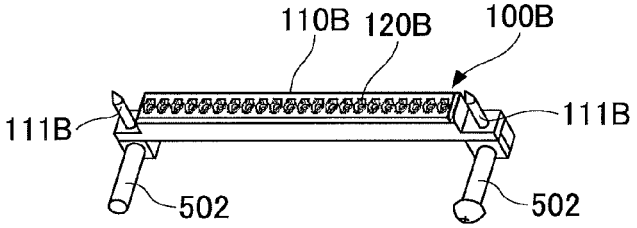
Figure 3C:
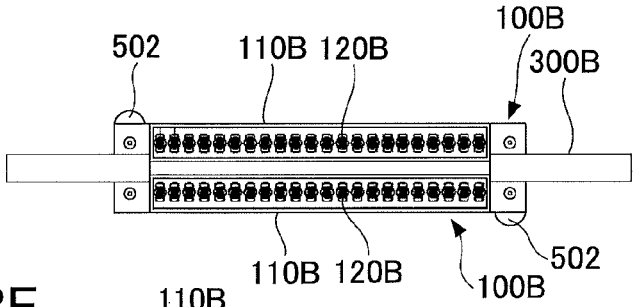
Figure 3D:
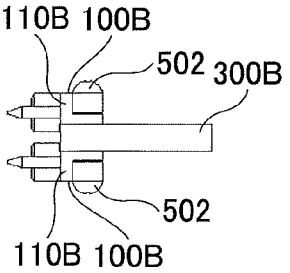
Figure 3E:
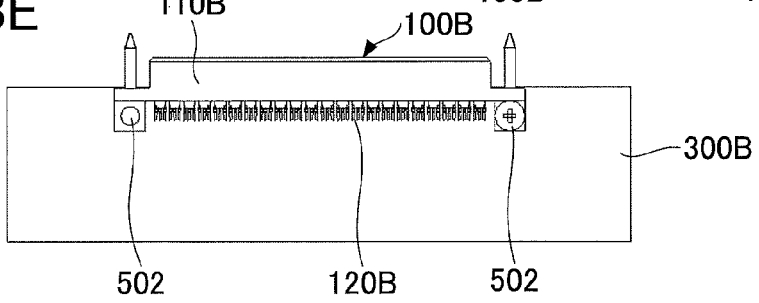

FIG. 3A is a perspective view illustrating two (a pair of) connectors 100B attached to the board 300B. FIG. 3B is a perspective view of one of the two connectors 100B. FIG. 3C is a front view, FIG. 3D is a side view, and FIG. 3E is a plan view of the connectors 100B.

As illustrated by FIG. 3A, the pair of connectors 100B are attached to the corresponding surfaces of the board 300B along an edge of the board 300B. The pair of connectors 100B are disposed along an edge of the board 300B and fixed to the corresponding surfaces of the board 300B with a pair of screws 502 such that the board 300B is sandwiched by the connectors 100B. Through holes corresponding to the screws 502 are formed in the board 300B. The screws 502 are screwed into the through holes in opposite directions from each other.

As illustrated by FIGS. 3A, 3B, and 3C, each connector 100B is formed by fitting forty-four contacts 120B into the corresponding forty-four through holes of a housing 110B. Each contact 120B includes a first end and a second end, and extends along the corresponding surface of the board 300B. The contacts 120B may be comprised of, for example, a metal such as copper or nickel.

The housing 110B may be comprised of an insulating material such as an epoxy resin. The housing 110B has a cuboid shape. Forty-four through holes for inserting forty-four contacts 120B are formed in the housing 110B.

The first ends of the contacts 120B are illustrated in FIGS. 3A through 3C, and the second ends of the contacts 120B are illustrated in FIG. 3E. The first ends of the contacts 120B face outside of the board 300B in plan view, and the second ends of the contacts 120B face an opposite direction i.e., face a central portion of the board 300B in plan view. The first ends of the contact 120B are connected to the connector 410B of the FPC assembly 400, and the second ends of the contact 120B are connected to the signal lines and the ground lines of the board 300B. In FIGS. 1A, 1B, 3A, and 3E, the signal lines and the ground lines of the board 300B are omitted.

The housing 110B includes a pair of guide pins 111B. The guide pins 111B protrude from the housing 110B in the same direction that the first ends of the contacts 120B face, and guide the connector 410B of the FPC assembly 400 when the connector 410B is connected to the connector 100B. For example, the guide pins 111B may be comprised of a metal such as copper or nickel, or a resin.

Figure 4A:
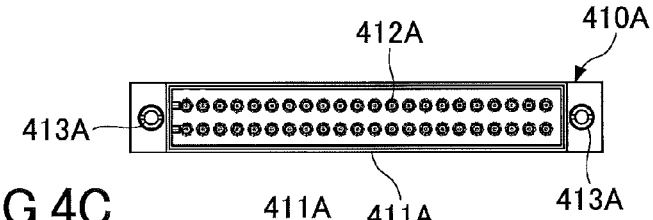
FIGS. 4A through 4E are drawings illustrating a connector of an FPC assembly.
Figure 4B:
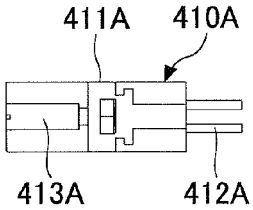
Figure 4C:
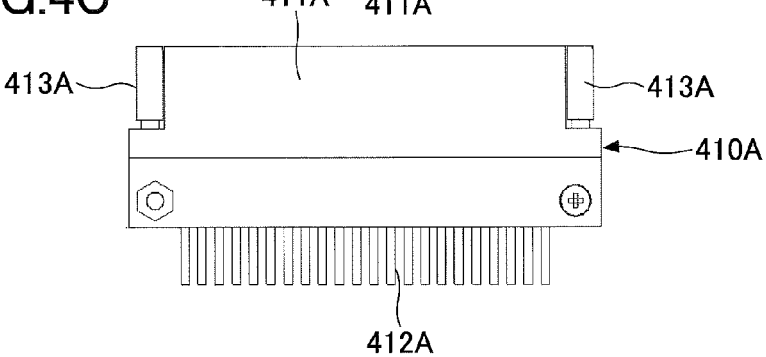
Figure 4D:
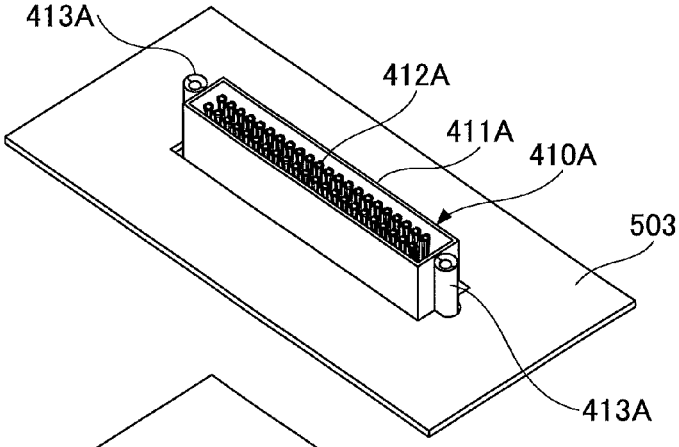
Figure 4E:
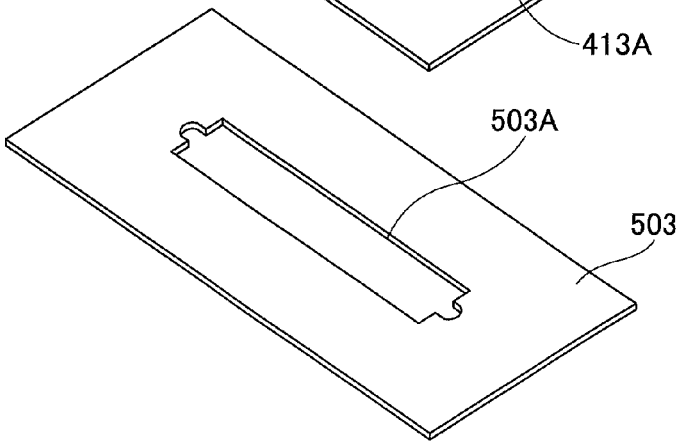

FIG. 4A is a front view, FIG. 4B is a side view, and FIG. 4C is a plan view of the connector 410A of the FPC assembly 400 to which the connector 100A is to be connected. FIG. 4D is a perspective view illustrating the connector 410A attached to a metal plate 503. FIG. 4E illustrates the metal plate 503.

The connector 410A includes a housing 411A, coaxial pins 412A, and guide pins 413A. The coaxial pins 412A are used for the connector 410A to reduce reflection and transmission loss of a signal transmitted between the FPCs 420 and the board 300A and to improve signal transmission characteristics.

The coaxial pins 412A are fitted into the corresponding forty-four through holes of the housing 411A. First ends of the coaxial pins 412A are illustrated in FIGS. 4A and 4D, and are to be connected to the first ends of the contacts 120A of the connector 100A. Second ends of the coaxial pins 412A are illustrated in FIG. 4C, and are to be connected to the signal lines and the ground lines of the FPCs 420 (see FIGS. 1A and 1B). The coaxial pins 412A may be comprised of, for example, a metal such as copper or nickel.

The guide pins 413A are screwed into the housing 411A. The housing 411A is fixed to the metal plate 503 by inserting the housing 411A into an opening 503A of the metal plate 503 illustrated in FIG. 4E, and by screwing the guide pins 413A into the housing 411A from above as illustrated in FIG. 4D.

The guide pins 111A of the connector 100A are inserted into the guide pins 413A to align the connector 100A with the connector 410A. For example, the guide pins 413A may be comprised of a metal such as copper or nickel, or a resin.

A recessed part is formed at the bottom of each guide pin 413A to accept the thickness of the metal plate 503 when the guide pin 413A is screwed into the housing 411A. The recessed part has a diameter that is smaller than the diameter of other parts of the guide pin 413A.

The metal plate 503 is used when connecting the connector 100A to the connector 410A. For example, multiple connectors 410A may be arranged on one metal plate 503 so that multiple connectors 100A can be easily connected to the corresponding connectors 410A. The metal plate 503 may be implemented by any plate-shaped part. For example, a plate made of a resin instead of a metal may be used in place of the metal plate 503.

Figure 5A:
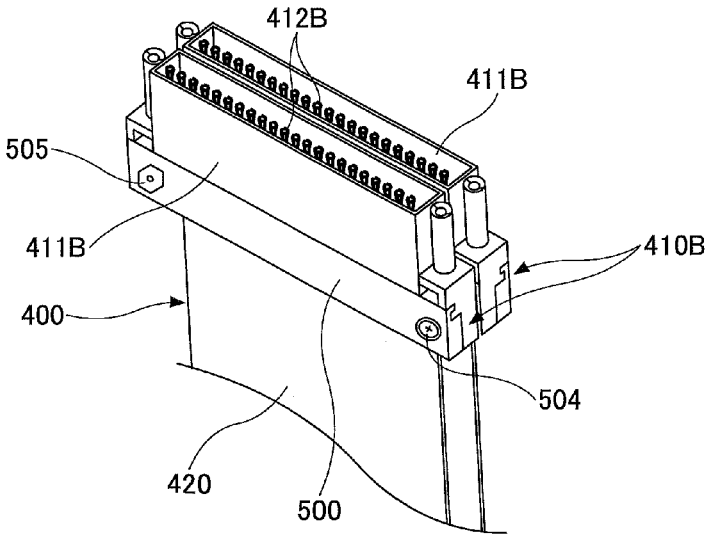
FIGS. 5A through 5D are drawings illustrating a connector of an FPC assembly.
Figure 5B:
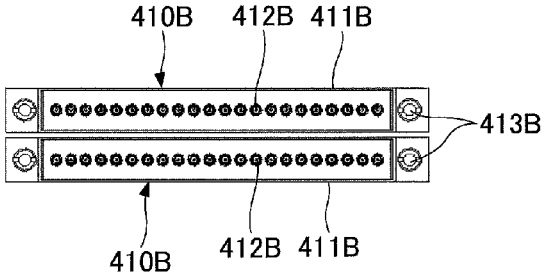
Figure 5C:
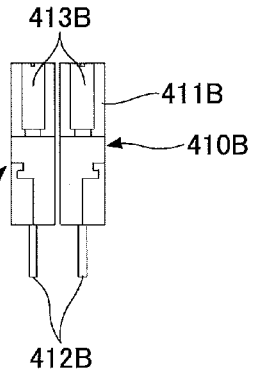
Figure 5D:
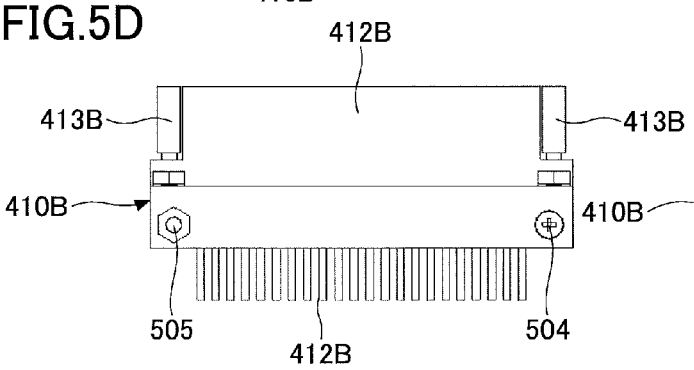

FIG. 5A is a perspective view, FIG. 5B is a front view, FIG. 5C is a side view, and FIG. 5D is a plan view of the connector 410B of the FPC assembly 400 to which the connector 100B is to be connected.

The connector 410B includes a housing 411B, coaxial pins 412B, and guide pins 413B. The coaxial pins 412B are used for the connector 410B to reduce reflection and transmission loss of a signal transmitted between the FPCs 420 and the board 300B and to improve signal transmission characteristics.

Twenty-two coaxial pins 412B are fitted into the corresponding twenty-two through holes of the housing 411B. Two connectors 410B are used as a pair and connected to the FPCs 420.

First ends of the coaxial pins 412B are illustrated in FIGS. 5A and 5B, and are to be connected to the first ends of the contacts 120B of the connectors 100B. Second ends of the coaxial pins 412B are illustrated in FIG. 5D, and are to be connected to the signal lines and the ground lines of the FPCs 420 (see FIGS. 1A and 1B). The coaxial pins 412B may be comprised of, for example, a metal such as copper or nickel.

The guide pins 413B are screwed into the housing 411B. The guide pins 111B of the connectors 100B are inserted into the guide pins 413B to align the connectors 100B with the connectors 410B. For example, the guide pins 413B may be comprised of a metal such as copper or nickel, or a resin.

The pair of connectors 410B are fixed to each other with two pairs of screws 504 and nuts 505. The screws 504 are screwed into the connectors 410B in opposite directions from each other. The screws 504 and the nuts 505 also fix holders 500 to the connectors 410B. The holders 500 are used to fix the FPCs 420 to the connectors 410B.

A recessed part similar to the recessed part of the guide pin 413A of the connector 410A is formed at the bottom of each guide pin 413B. The recessed parts of the guide pins 413B make it possible to fix multiple connectors 410B to a metal plate similar to the metal plate 503 and to easily connect multiple connectors 100B to the connectors 410B.

Figure 6A:
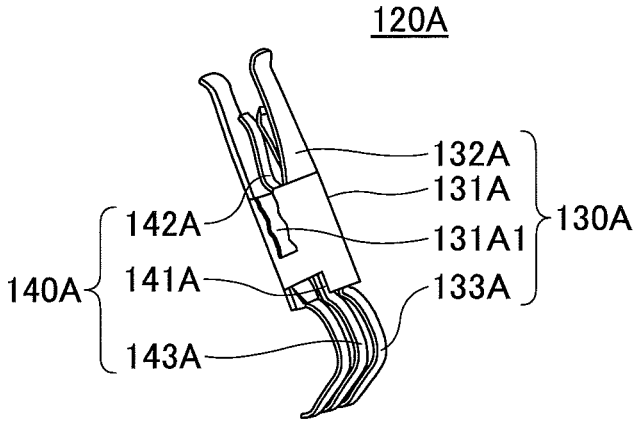
FIGS. 6A and 6B are drawings illustrating a contact according to the first embodiment.
Figure 6B:
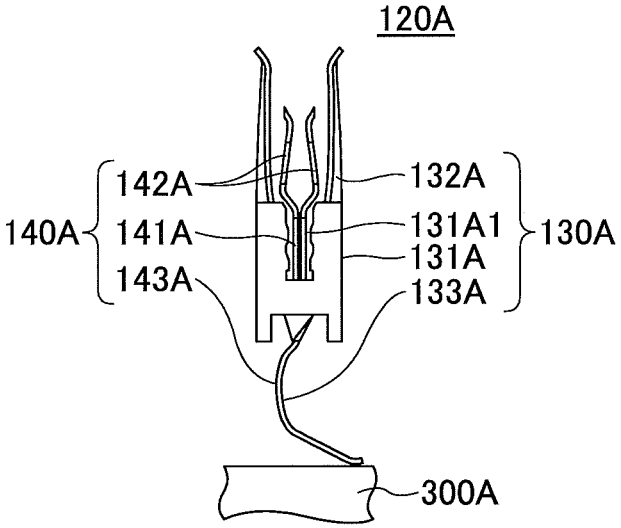

FIG. 6A is a perspective view and FIG. 6B is a side view of the contact 120A of the first embodiment.

The contact 120A includes a ground terminal 130A and a signal terminal 140A. The ground terminal 130A includes a base 131A, connection parts 132A, and connection parts 133A.

The base 131A has a cylindrical shape, and the connection parts 132A and 133A are connected to the corresponding ends of the cylindrical base 131A. A pair of slits 131A1 are formed in the base 131A along the central axis of the cylindrical shape from the end to which the connection parts 132A are connected. The slits 131A1 are formed to position the base 131A relative to the housing 110A, and to allow a part of the housing 110A to enter the base 131A and hold the signal terminal 140A.

The connection parts 132A are conductive parts extending from a first end of the base 131A along the central axis of the cylindrical shape, and are connected to a ground terminal of the coaxial pin 412A of the connector 410A. The connection parts 132A have a leaf spring structure configured such that a spring elastic force acts in a direction to reduce the distance between the connection parts 132A when a ground terminal of the coaxial pin 412A is inserted between the connection parts 132A.

The connection parts 133A are conductive parts extending from a second end of the base 131A, and form a coplanar line together with a connection part 143A of the signal terminal 140A. That is, the connection parts 133A implement ground lines of a coplanar line that are located on the sides of a signal line. For this reason, the connection parts 133A curve along the connection part 143A.

The connection parts 133A have a leaf spring structure having spring elasticity. When the connection parts 133A are pressed in a direction of the central axis of the base 131A, ends of the connection parts 133A are pressed against the corresponding ground lines of the board 300A (see FIGS. 1A and 1B) by an elastic force. This leaf spring structure enables reliable electrical connection between the ends of the connection parts 133A and the ground lines of the board 300A.

The signal terminal 140A includes a base 141A and connection parts 142A and 143A.

The base 141A is a narrow plate-like part disposed between the connection parts 142A and the connection part 143A. The connection parts 142A and 143A are connected to the corresponding ends of the base 141A. The width and thickness of the base 141A are set such that the base 141A can be housed in the base 131A. The base 141A and the base 131A are held by the housing 110A such that the central axis of the base 141A coincides with the central axis of the base 131A.

The connection parts 142A are conductive parts extending from a first end of the base 141A along the central axis of the cylindrical shape, and are to be connected to a signal terminal of the coaxial pin 412A of the connector 410A. The connection parts 142A are disposed inside of the connection parts 132A of the ground terminal 130A. The connection parts 142A have a leaf spring structure configured such that a spring elastic force acts in a direction to reduce the distance between the connection parts 142A when a signal terminal of the coaxial pin 412A is inserted between the connection parts 142A.

The connection part 143A is a conductive part extending from a second end of the base 141A. The connection part 143A is disposed between the connection parts 133A of the ground terminal 130A, and forms a coplanar line together with the connection parts 133A. That is, the connection part 143A implements a signal line of a coplanar line that is located between ground lines of the coplanar line. For this reason, the connection part 143A curves along the connection parts 133A.

The connection part 143A has a leaf spring structure having spring elasticity. When the connection part 143A is pressed in a direction of the central axis of the base 131A, an end of the connection part 143A is pressed against the corresponding signal line of the board 300A (see FIGS. 1A and 1B) by an elastic force. This leaf spring structure enables reliable electrical connection between the end of the connection part 143A and the signal line of the board 300A.

As described above, the contact 120A includes the ground terminal 130A and the signal terminal 140A, and the base 141A and the connection parts 142A of the signal terminal 140A are disposed inside of the base 131A and the connection parts 132A of the ground terminal 130A, respectively. This configuration makes it possible to sufficiently match the impedance of the base 141A and the connection parts 142A with the impedance of the base 131A and the connection parts 132A, and makes it possible to reduce reflection and transmission loss of a signal and improve signal transmission characteristics.

Also, the connection part 143A of the signal terminal 140A and the connection parts 133A of the ground terminal 130A constitute a coplanar line. This configuration also makes it possible to reduce reflection and transmission loss of a signal and improve signal transmission characteristics.

Thus, the contact 120A is configured to improve signal transmission characteristics between the board 300A and the connector 410A and achieve predetermined characteristic impedance (e.g., 50Ω).

Figure 7:
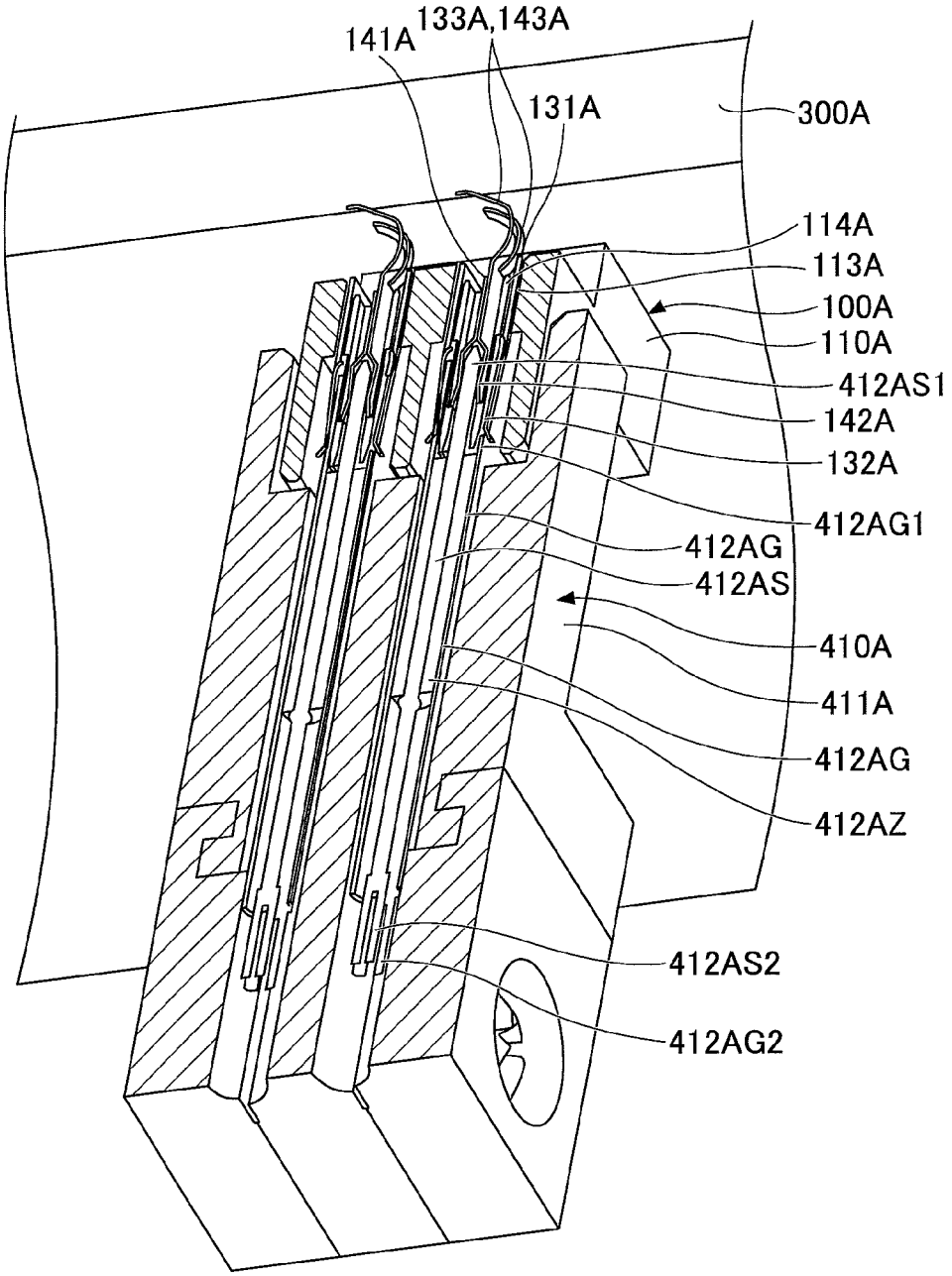
FIG. 7 is a perspective cut-away side view of a connector and a connector of an FPC assembly that are connected to each other.

FIG. 7 is a perspective cut-away side view of the connector 100A and the connector 410A of the FPC assembly 400 that are connected to each other.

As illustrated by FIG. 7, the base 131A and the connection parts 132A of the ground terminal 130A are housed in a through hole 113A of the housing 110A, and the base 131A is fixed by walls 114A formed inside of the through hole 113A. The walls 114A are formed in the through hole 113A to fix the base 131A.

The base 141A of the signal terminal 140A is disposed inside of the walls 114A and fixed to the housing 110A by walls (not shown) similar to the walls 114A.

A first end 412AS1 of a signal line 412AS of the coaxial pin 412A is fitted between the connection parts 142A of the signal terminal 140A. Also, a first end 412AG1 of a ground line 412AG of the coaxial pin 412A is fitted between the connection parts 132A of the ground terminal 130A. With this configuration, the connector 100A and the connector 410A are electrically connected to each other. The signal line 412AS and the ground line 412AG are insulated from each other with an insulator 412AZ. The insulator 412AZ also determines the relative positions of the signal line 412AS and the ground line 412AG.

The connection parts 133A of the ground terminal 130A and the connection part 143A of the signal terminal 140A are elastically bent (or biased) while they are connected, respectively, to the ground lines and the signal line of the board 300A. This configuration makes it possible to electrically connect the connection parts 133A and the connection part 143A with the ground lines and the signal line of the board 300A.

A second end 412AS2 of the signal line 412AS and a second end 412AG2 of the ground line 412AG of the coaxial pin 412A are connected, respectively, to a signal line and ground lines of the FPC 420 of the FPC assembly 400.

Connecting the connector 100A and the connector 410A with good characteristic impedance as illustrated in FIG. 7 makes it possible to improve signal transmission characteristics between the board 300A and the FPCs 420.

Figure 8A:
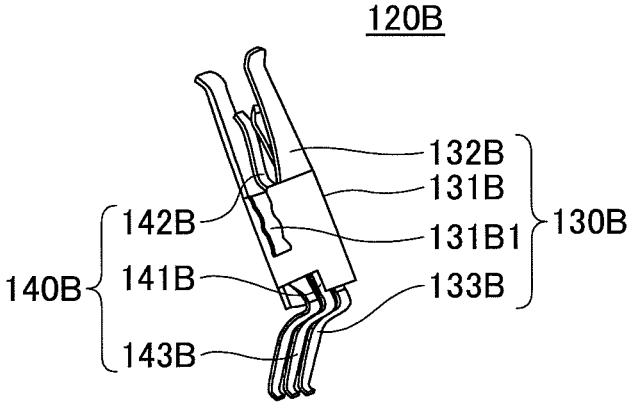
FIGS. 8A and 8B are drawings illustrating a contact according to the first embodiment.
Figure 8B:
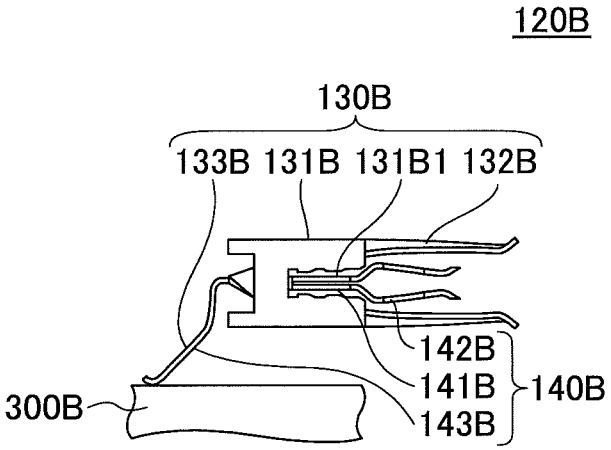

FIG. 8A is a perspective view and FIG. 8B is a side view of the contact 120B of the first embodiment.

The contact 120B includes a ground terminal 130B and a signal terminal 140B. The ground terminal 130B includes a base 131B and connection parts 132B and 133B.

The base 131B has a cylindrical shape, and the connection parts 132A and 133A are connected to the corresponding ends of the base 131B. Slits 131B1 are formed in the base 131B along the central axis of the cylindrical shape from the end to which the connection parts 132B are connected. The slits 131B1 are formed to position the base 131B relative to the housing 110B, and to allow a part of the housing 110B to enter the base 131B and hold the signal terminal 140B.

The connection parts 132B are conductive parts extending from a first end of the base 131B along the central axis of the cylindrical shape, and are connected to a ground terminal of the coaxial pin 412B of the connector 410B. The connection parts 132B have a leaf spring structure configured such that a spring elastic force acts in a direction to reduce the distance between the connection parts 132B when a ground terminal of the coaxial pin 412B is inserted between the connection parts 132B.

The connection parts 133A are conductive parts extending from a second end of the base 131B, and form a coplanar line together with a connection part 143B of the signal terminal 140B. That is, the connection parts 133B implement ground lines of a coplanar line that are located on the sides of a signal line. For this reason, the connection parts 133B curve along the connection part 143B.

The connection parts 133B have a leaf spring structure having spring elasticity. When the connection parts 133B are pressed in a direction that is substantially perpendicular to the central axis of the base 131B, ends of the connection parts 133B are pressed against the corresponding ground lines of the board 300B (see FIGS. 1A and 12) by an elastic force. This leaf spring structure enables reliable electrical connection between the connection parts 133B and the ground lines of the board 300B. The direction in which the connection parts 133B are pressed is not limited to the direction that is substantially perpendicular to the central axis of the base 131B, as long as the direction intersects with the central axis of the base 131B.

The signal terminal 140B includes a base 141B and connection parts 142B and 143B.

The base 141B is a narrow plate-like part disposed between the connection parts 142B and the connection part 143B. The connection parts 142B and 143B are connected to the corresponding ends of the base 141B. The width and thickness of the base 141B are set such that the base 141B can be housed in the base 131B. The base 141B and the base 131B are held by the housing 110B such that the central axis of the base 141B coincides with the central axis of the base 131B.

The connection parts 142B are conductive parts extending from a first end of the base 141B along the central axis of the cylindrical shape, and are connected to a signal terminal of the coaxial pin 412B of the connector 410B. The connection parts 142B are disposed inside of the connection parts 132B of the ground terminal 130B. The connection parts 142B have a leaf spring structure configured such that a spring elastic force acts in a direction to reduce the distance between the connection parts 142B when a signal terminal of the coaxial pin 412B is inserted between the connection parts 142B.

The connection part 143B is a conductive part extending from a second end of the base 141B. The connection part 143B is disposed between the connection parts 133B of the ground terminal 130B, and forms a coplanar line together with the connection parts 133B. That is, the connection part 143B implements a signal line of a coplanar line that is located between ground lines the coplanar line. For this reason, the connection part 143B curves along the connection parts 133B.

The connection part 143B has a leaf spring structure having spring elasticity. When the connection part 143B is pressed in a direction that is substantially perpendicular to the central axis of the base 141B, an end of the connection part 143B is pressed against the corresponding signal line of the board 300B (see FIGS. 1A and 1B) by an elastic force. This leaf spring structure enables reliable electrical connection between the connection part 143B and the signal line of the board 300B. The direction in which the connection part 143B is pressed is not limited to the direction that is substantially perpendicular to the central axis of the base 141B, as long as the direction intersects with the central axis of the base 141B.

As described above, the contact 120B includes the ground terminal 130B and the signal terminal 140B and has a configuration similar to the configuration of the contact 120A.

Accordingly, the contact 120B is configured to improve signal transmission characteristics between the board 300B and the connector 410B and achieve predetermined characteristic impedance (e.g., 50Ω).

Figure 9:
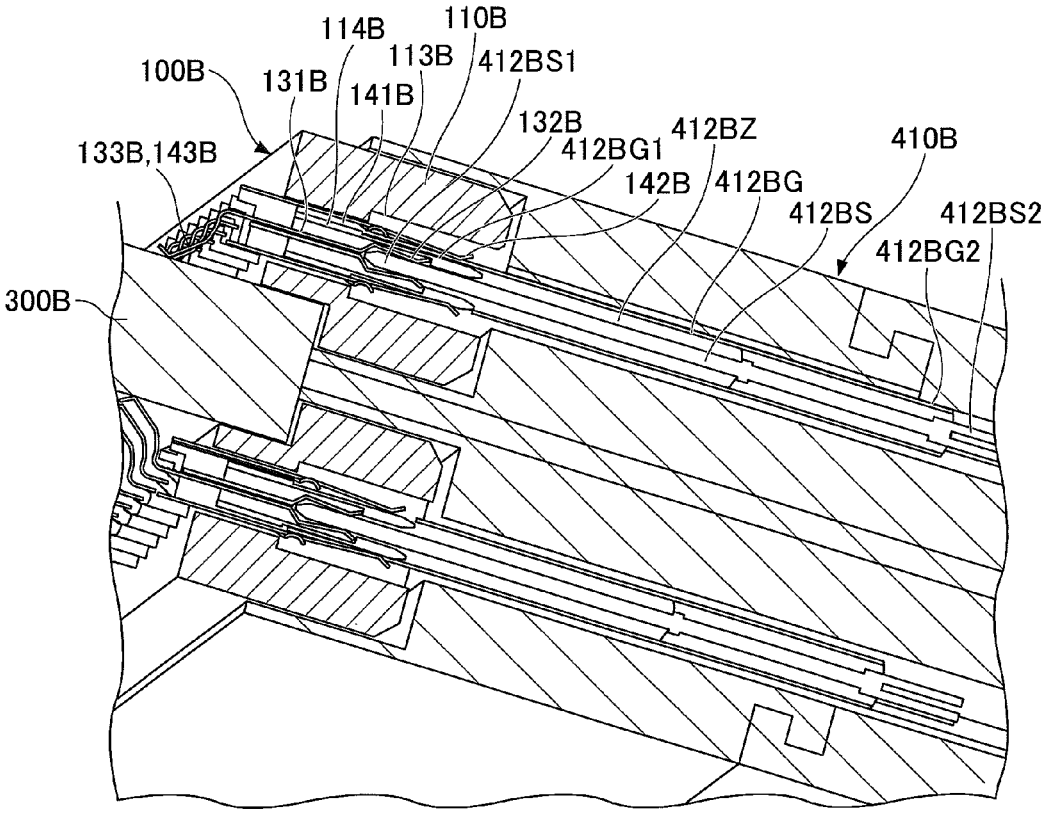
FIG. 9 is a perspective cut-away side view of a connector and a connector of an FPC assembly that are connected to each other.

FIG. 9 is a perspective cut-away side view of the connector 100B and the connector 410B of the FPC assembly 400 that are connected to each other. Although two connectors 100B are fixed to an end of the board 300B in FIG. 9, one of the connector 100B is used for descriptions below because the two connectors 100B have the same configuration.

As illustrated by FIG. 9, the base 131B and the connection parts 132B of the ground terminal 130B are housed in a through hole 113B of the housing 110B, and the base 131B is fixed by walls 114B formed inside of the through hole 113B.

The base 141B of the signal terminal 140B is disposed inside of the walls 114B and fixed to the housing 110B by walls (not shown) similar to the walls 114B.

An end 412BS1 of a signal line 412BS of the coaxial pin 412B is fitted between the connection parts 142B of the signal terminal 140B. Also, an end 412BG1 of a ground line 412BG of the coaxial pin 412B is fitted between the connection parts 132B of the ground terminal 130B. With this configuration, the connector 100B and the connector 410B are electrically connected to each other. The signal line 412BS and the ground line 412BG are insulated from each other with an insulator 412BZ. The insulator 412BZ also determines the relative positions of the signal line 412BS and the ground line 412BG.

The connection parts 133B of the ground terminal 130B and the connection part 143B of the signal terminal 140B are elastically bent while they are connected, respectively, to the ground lines and the signal line of the board 300B. This configuration makes it possible to electrically connect the connection parts 133B and the connection part 143B with the ground lines and the signal line of the board 300B.

Another end 412BS2 of the signal line 412BS and another end 412BG2 of the ground line 412BG of the coaxial pin 412B are connected, respectively, to a signal line and ground lines of the FPC 420 of the FPC assembly 400.

Figure 10:
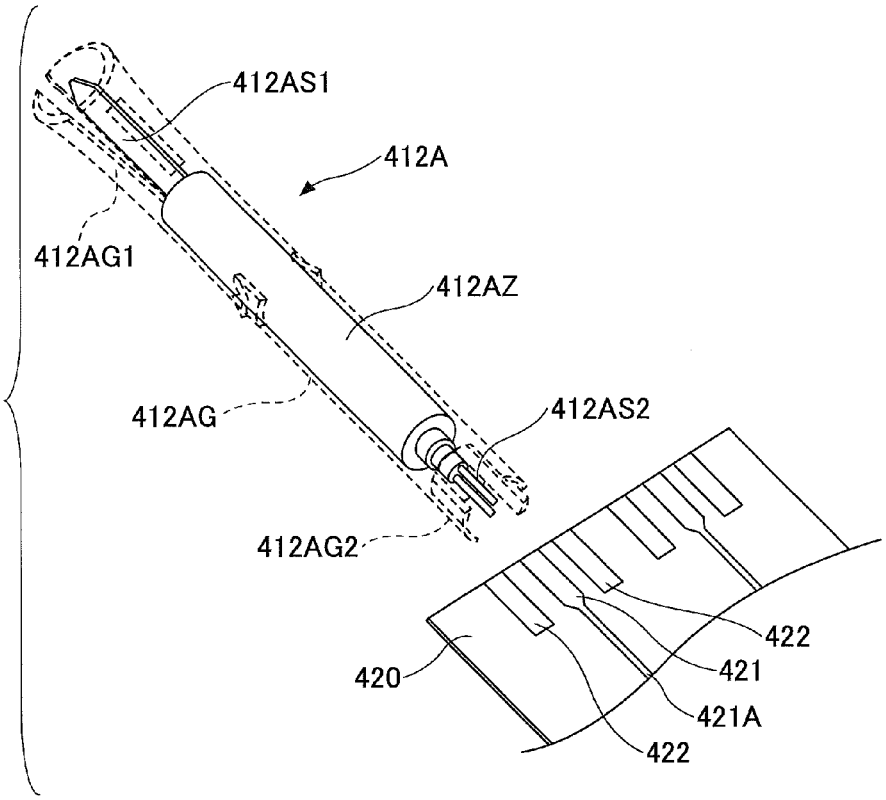
FIG. 10 is a drawing illustrating a coaxial pin of a connector.
Figure 11:
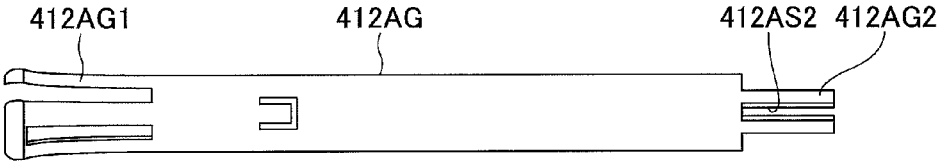
FIG. 11 is a drawing illustrating a coaxial pin of a connector.

FIGS. 10 and 11 are drawings illustrating the coaxial pin 412A of the connector 410A to be connected to the connector 100A of the first embodiment. The coaxial pin 412B of the connector 410B to be connected to the connector 100B has substantially the same configuration as the coaxial pin 412A of the connector 410A. Therefore, the following descriptions of the coaxial pin 412A may also be applied to the coaxial pin 412B.

The coaxial pin 412A includes the signal line 412AS, the ground line 412AG, and the insulator 412AZ.

The signal line 412AS is disposed inside of the cylindrical ground line 412AG and is held by the insulator 412AZ coaxially with the ground line 412AG. With this configuration, the first end 412AS1 of the signal line 412AS and the first end 412AG1 of the ground line 412AG are disposed coaxially with each other. Also, the second end 412A52 of the signal line 412AS and the second end 412AG2 of the ground line 412AG are also disposed coaxially with each other.

Slits are formed in the first end 412AG1 of the ground line 412AG to implement a leaf spring structure. This leaf spring structure makes it easier to fit the connection parts 132A of the connector 100A into the ground line 412AG.

Slits are also formed in the second end 412AS2 of the signal line 412AS and the second end 412AG2 of the ground line 412AG to provide them with leaf spring structures. The slits of the second end 412AS2 and the second end 412AG2 are formed at corresponding positions so that the FPC 420 can be inserted into the slits.

The second end 412AS2 of the signal line 412AS is connected to a signal terminal 421 of the FPC 420, and the second end 412AG2 of the ground line 412AG is connected to ground lines 422 of the FPC 420.

The reliability of electrical connection of the second end 412AS2 of the signal line 412AS and the second end 412AG2 of the ground line 412AG with the signal terminal 421 and the ground lines 422 of the FPC 420 can be improved by crimping or soldering them together after positioning and inserting the FPC 420 into the slits of the second end 412AS2 and the second end 412AG2. For example, using pulse-heated solder for the soldering makes it possible to reduce assembly costs.

With the connector 100A including the contacts 120A and the connector 100B including the contacts 120B of the first embodiment, it is possible to connect the connector 100A and the connector 410A and connect the connector 100B and the connector 410B while achieving the impedance matching.

That is, the first embodiment makes it possible to connect the board 300A and the FPCs 420 and connect the board 300B and the FPCs 420 while achieving the impedance matching.

Thus, the first embodiment provides the connectors 100A and 100B and the contacts 120A and 120B that make it possible to transmit a signal in an impedance matched state.

In the above embodiment, each of the housings 110A and 110B has forty-four through holes 113A or 113B, and the contacts 120A and 120B are guided and held by the through holes 113A and 113B.

However, the housings 110A and 110B may have guide grooves instead of the through holes 113A and 113B, and the contacts 120A and 120B may be guided and held by the guide grooves of the housings 110A and 110B. The through holes 113A and 113B can be construed as covered grooves, and are therefore examples of guide grooves.

Figure 12:
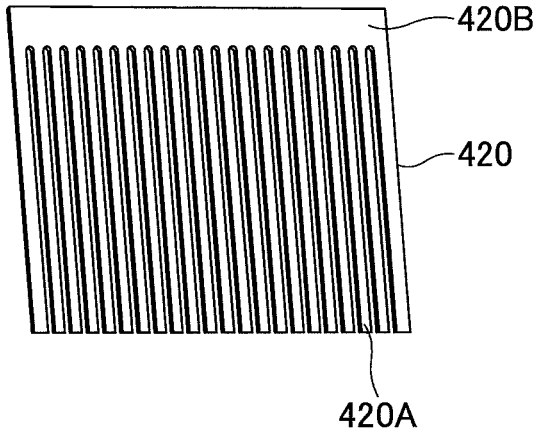
FIG. 12 is a drawing illustrating a variation of an FPC.

The FPC 420 may be modified as described below. FIG. 12 is a drawing illustrating a variation of the FPC 420. In FIG. 12, slits 420A are formed in the FPC 420 such that multiple strips are joined at an end 420B. In this case, signal lines and ground lines may be formed on the strips separated by the slits 420A to form structures similar to microstrip lines or coplanar lines having predetermined characteristic impedance (e.g., 50Ω).

The first embodiment may also be modified to use a coaxial cable assembly instead of the FPC assembly 400.

Figure 13A:
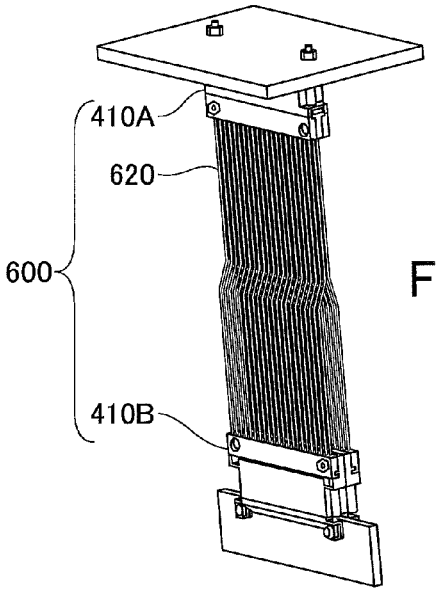
FIGS. 13A and 13B are drawings illustrating connectors and a coaxial cable assembly.
Figure 13B:
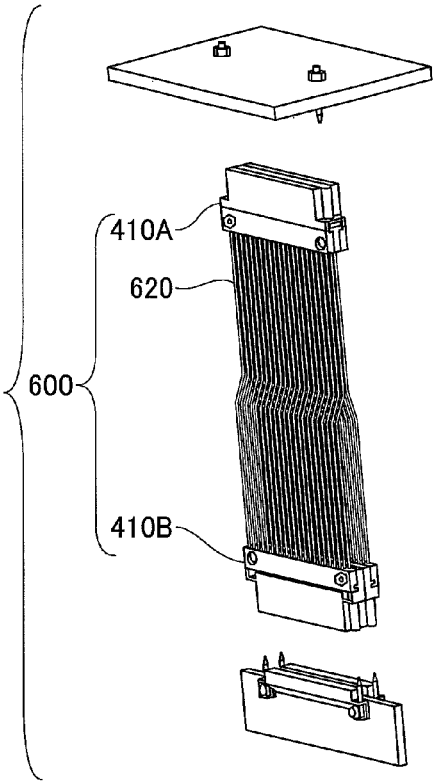

FIGS. 13A and 13B are drawings illustrating a coaxial cable assembly 600 connected between the connectors 100A and 100A.

The coaxial cable assembly 600 includes connectors 410A and 410B and two coaxial cable bundles 620. Each of the coaxial cable bundles 620 includes twenty-two sets of a signal line and a ground line, and the characteristic impedance of the signal line is set at a predetermined value (e.g., 50Ω). The connector 410A is connected to first ends of the coaxial cable bundles 620, and the connector 410B is connected to second ends of the coaxial cable bundles 620.

Thus, the coaxial cable assembly 600 is obtained by replacing the FPC 420 of the FPC assembly 400 of FIGS. 1A and 1B with the coaxial cable bundles 620. Each of the coaxial cable bundles 620 is formed by binding twenty-two coaxial cables.

In FIG. 13A, the connectors 410A and 410B of the coaxial cable assembly 600 are connected to the corresponding connectors 100A and 100B.

When the coaxial cable assembly 600 is used, each coaxial connector of the coaxial cable bundles 620 may be connected to the second end 412AS2 and the second end 412AG2 of the coaxial pin 412A. Also, a coaxial pin 412C illustrated by FIG. 14 may instead be used for the connection.

Figure 14:
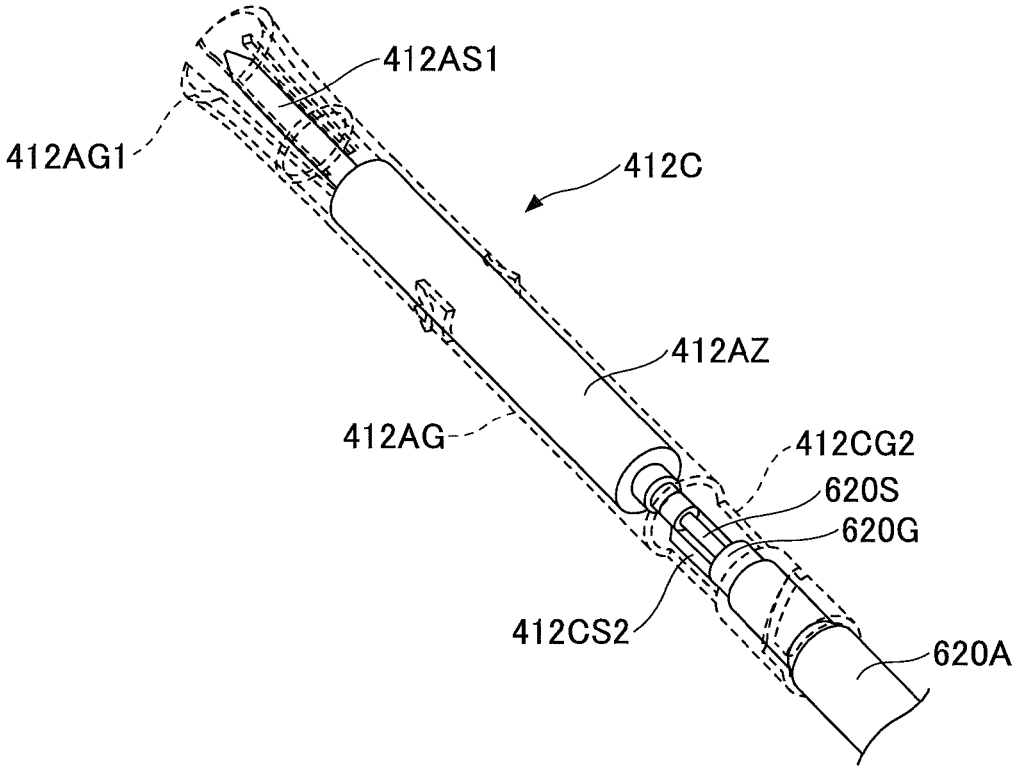
FIG. 14 is a drawing illustrating a coaxial pin.

FIG. 14 is a drawing illustrating the coaxial pin 412C. The coaxial pin 412C has a configuration that is obtained by replacing the second end 412AS2 and the second end 412AG2 of the coaxial pin 412A with a second end 412CS2 and a second end 4120G2. Accordingly, except for the second end 4120S2 and the second end 412CG2, the configuration of the coaxial pin 412C is substantially the same as the configuration of the coaxial pin 412A of FIG. 10.

Unlike the second end 412AS2 and the second end 412AG2, no slit is formed in the second end 412CS2 and the second end 412CG2. The second end 4120S2 has a tubular shape so that a core wire 620S of one of coaxial cables 620A (see FIG. 13) can be inserted into the second end 412CS2. The second end 412CG2 also has a tubular shape such that a shielded line 620G of the coaxial cable 620A can be inserted into the second end 412CG2.

Second Embodiment

Figure 15A:
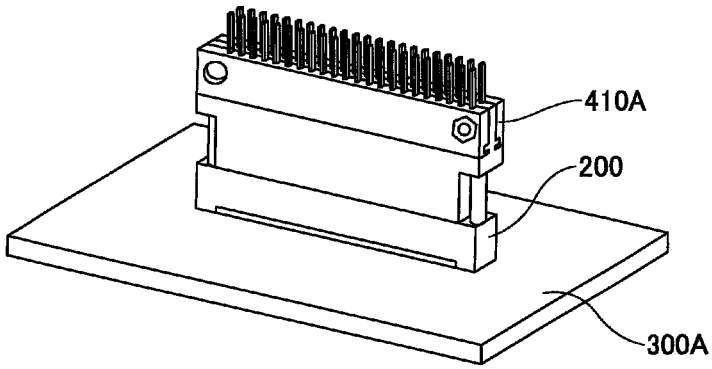
FIGS. 15A and 15B are drawings illustrating a connector of a second embodiment disposed between a board and another connector.
Figure 15B:
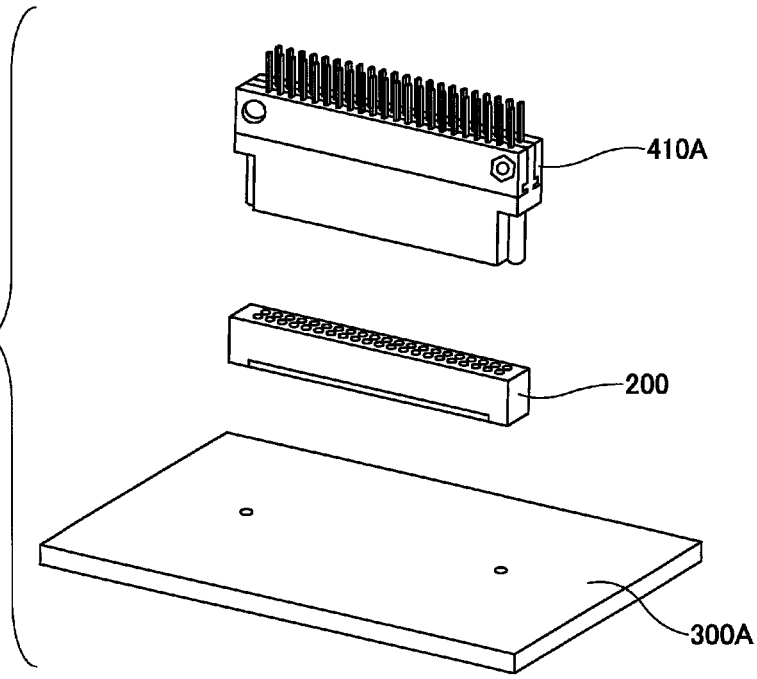

FIG. 15A illustrates a connector 200 of a second embodiment that is connected between the board 300A and the connector 410A. FIG. 15B illustrates the connector 200, the board 300A, and the connector 410A that are separated from each other.

In FIG. 15, the connector 200 is used in place of the connector 100A illustrated in FIGS. 1A and 1B, and is connected between the board 300A and the connector 410A. However, the connector 200 may also be used in place of the connector 100B and may be connected between the board 300B and the connector 410B.

Figure 16A:
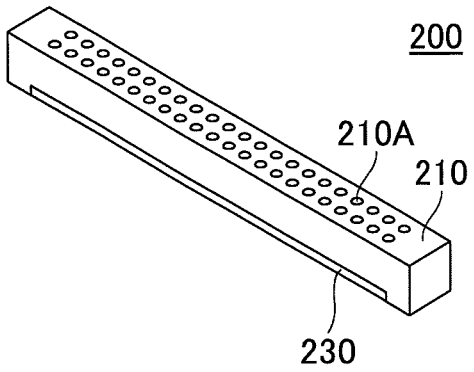
FIGS. 16A through 16C are drawings illustrating a connector according to the second embodiment.
Figure 16B:
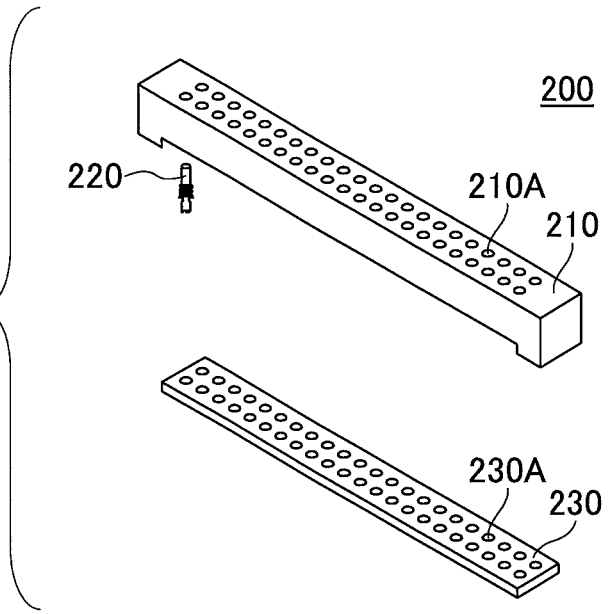
Figure 16C:
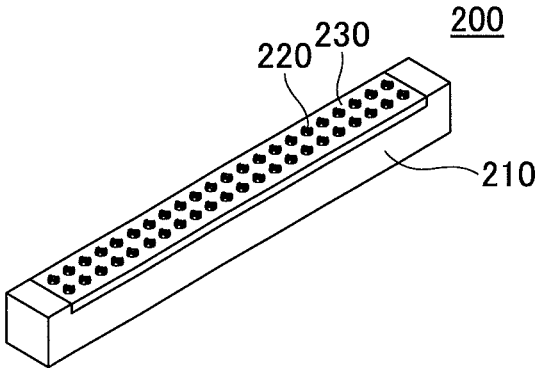

FIG. 16A is a perspective view and FIG. 16B is a perspective exploded view of the connector 200 of the second embodiment. FIG. 16C is an inverted view of FIG. 16A.

The connector 200 includes a housing 210, contacts 220, and a bracket 230.

The connector 200 is formed by fitting forty-four contacts 220 into the corresponding forty-four through holes of the housing 210 and the bracket 230.

The housing 210 may be comprised of an insulating material such as an epoxy resin. The housing 210 has a cuboid shape. Forty-four through holes 210A for inserting the forty-four contacts 220 are formed in the housing 210.

The bracket 230 may be comprised of an insulating material such as an epoxy resin. The bracket 230 is a plate-like part having a rectangular shape in plan view. Forty-four through holes 230A corresponding to the through holes 210A of the housing 210 are formed in the bracket 230. After the contacts 220 are inserted into the through holes 210A of the housing 210, the bracket 230 is attached to one side of the housing 210 to hold the contacts 220 in the through holes 210A.

Figure 17A:
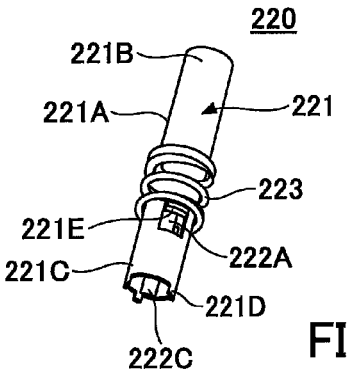
FIGS. 17A through 17C are drawings illustrating a contact according to the second embodiment.
Figure 17B:
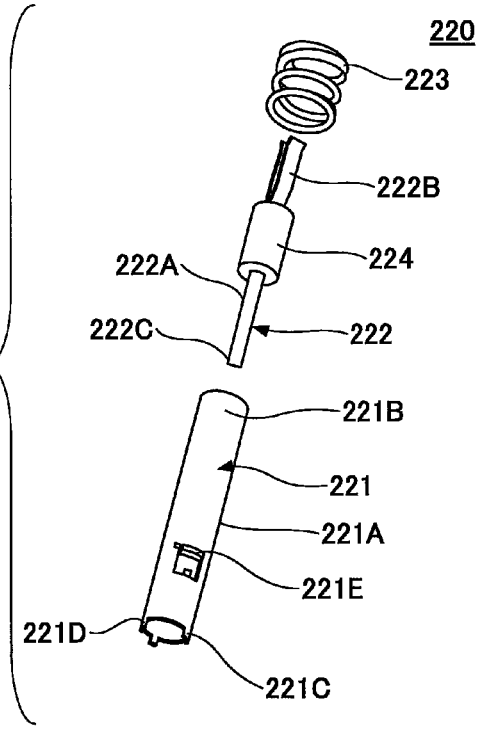
Figure 17C:
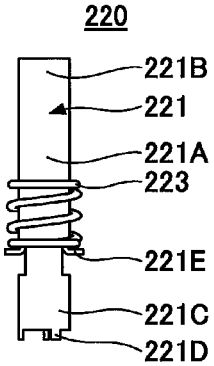

FIG. 17A is a perspective view, FIG. 17B is a perspective exploded view, and FIG. 17C is a side view of the contact 220 of the second embodiment.

The contact 220 includes a ground terminal 221, a signal terminal 222, a spring 223, and an insulator 224.

The ground terminal 221 includes a base 221A, a connection part 221B, and a connection part 221C.

The base 221A has a cylindrical shape, and the connection parts 221B and 221C are connected to the corresponding ends of the base 221A. A protrusion(s) 221E is formed in an outer wall of the base 221A by folding a part of the outer wall in a radial direction. Each of the connection parts 221B and 221C has a cylindrical shape, and has a configuration that looks like an extension of the base 221A.

The connection part 221B is a cylindrical conductive part extending from a first end of the base 221A along the central axis of the cylindrical shape, and is connected to the ground terminal of the coaxial pin 412A of the connector 410A.

The connection part 221C is a cylindrical conductive part extending from a second end of the base 221A. Three protrusions 221D are formed at an end of the connection part 221C. The protrusions 221D protrude in a direction of the central axis of the connection part 221C, and are arranged at regular intervals along the circumference of the connection part 221C in plan view.

The signal terminal 222 includes a base 222A and connection parts 222B and 222C.

The base 222A is a narrow plate-like part disposed between the connection parts 222B and 222C. The connection parts 222B and 222C are connected to the corresponding ends of the base 222A. The width and thickness of the base 222A are set such that the base 222A can be placed in a through hole of the insulator 224 housed in the base 221A. The base 222A is held by the insulator 224 relative to the ground terminal 221 such that the central axis of the base 222A coincides with the central axis of the base 221A.

The connection parts 222B are conductive parts extending from a first end of the base 222A, and are to be connected to a signal terminal of the coaxial pin 412A. The connection parts 222B have a configuration similar to the configuration of the connection parts 142A of the contact 120A of the first embodiment. The connection parts 222B have a leaf spring structure configured such that a spring elastic force acts in a direction to reduce the distance between the connection parts 222B when the signal terminal of the coaxial pin 412A is inserted between the connection parts 222B.

The connection part 222C is a narrow plate-like conductive part extending from a second end of the base 222A. The connection part 222C has a configuration that looks like an extension of the base 222B.

The spring 223 has a helical shape and is disposed around the outer surface of the ground terminal 221. The spring 223 engages with the protrusion 221B formed in the outer wall of the ground terminal 221 that is inserted into the spring 223. An upper end of the spring 223 in FIG. 17C engages with a step formed in the through hole 210A of the housing 210. With this configuration, the spring 223 presses the ground terminal 221 and the signal terminal 222 against the board 300A.

The insulator 224 is housed in the base 221A and holds the signal terminal 222 relative to the ground terminal 221. By being held by the insulator 224 that engages with the inner wall of the base 221A, the signal terminal 222 is positioned in the direction of the central axis of the ground terminal 221 and disposed such that the central axis of the signal terminal 222 coincides with the central axis of the ground terminal 221.

Figure 18:
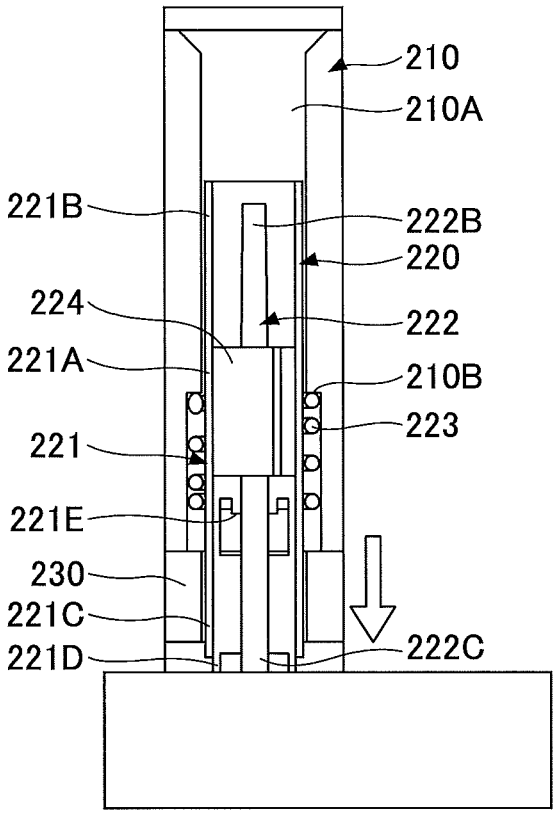
FIG. 18 is a drawing illustrating a mechanism for pressing a contact against a board.

FIG. 18 is a drawing illustrating a mechanism for pressing the contact 220 disposed in the through hole 210A of the housing 210 against the board 300A. In FIG. 18, only a part of the housing 210 including one through hole 210A necessary to describe the operation of the contact 220 is illustrated.

A step 210B is formed in the through hole 210A. The step 210B is formed by increasing the inner diameter of a middle part of the through hole 210A in the axial direction, and prevents the spring 223 from moving upward. The lower end of the spring 223 engages with an inner edge of the through hole 230A of the bracket 230, and the spring 223 is thereby prevented from moving downward. With this configuration, the spring 223 is held in a recess formed between the step 210B and the inner edge of the through hole 230A of the bracket 230.

With the contact 220 housed inside of the through hole 210A, the housing 210 is pressed toward the board 300A and fixed to connect the connection part 222C and the protrusions 221D to the signal line and the ground line of the board 300A.

Figure 19:
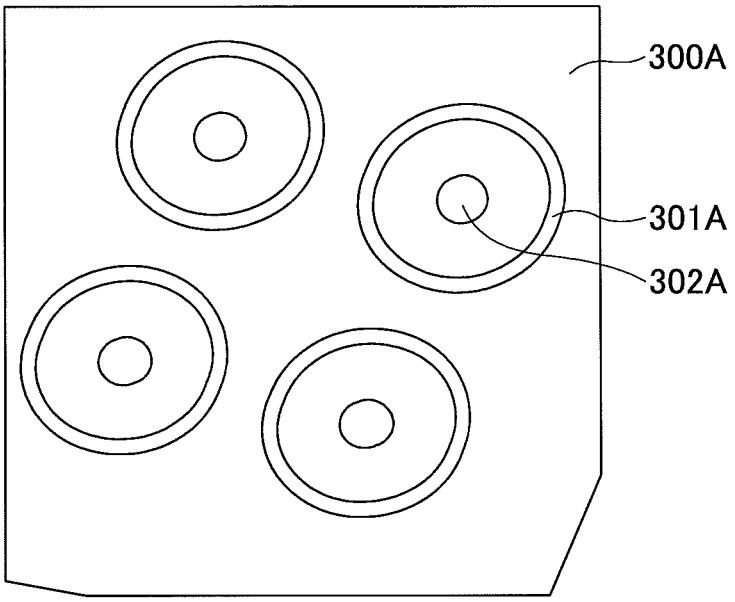
FIG. 19 is a drawing illustrating a surface of a board.

FIG. 19 is a drawing illustrating a surface of the board 300A to which the contact 220 of the second embodiment is to be connected. An annular conductive part 301A and a circular conductive part 302A positioned in the center of the conductive part 301A in plan view are formed on the board 300A, and are connected to a ground line and a signal line, respectively.

The protrusions 221D and the connection part 222C are brought into contact with the conductive part 301A and the conductive part 302A, respectively, to connect the contact 220 to the ground line and the signal line of the board 300A.

By using the connector 200 of the second embodiment including the contacts 220 as each of the connectors 100A and 100B, it is possible to connect the connector 100A and the connector 410A and connect the connector 100B and the connector 410B while achieving the impedance matching.

That is, the second embodiment makes it possible to connect the board 300A and the FPCs 420 and connect the board 300B and the FPCs 420 while achieving the impedance matching.

Thus, the second embodiment provides the connector 200 and the contacts 220 that make it possible to transmit a signal in an impedance matched state.

Connectors and contacts according to embodiments of the present invention are described above. However, the present invention is not limited to the specifically disclosed embodiments, and variations and modifications may be made without departing from the scope of the present invention.

What is claimed is:

1. An electrical connector for connecting a signal line and ground lines formed on a surface of a printed circuit board to a pin having a coaxial cable of a mating connector, the electrical connector comprising:

a housing to be attached to the printed circuit board;

a ground terminal including a ground base that is disposed in the housing, a first ground connection part that extends from the ground base toward a first end of the housing and is to be connected to a ground line of the pin having the coaxial cable, and a pair of second ground connection parts that extend from the ground base toward a second end of the housing and are configured to elastically bend when the housing is attached to the printed circuit board and the pair of second ground connection parts are connected to the ground lines of the printed circuit board; and a signal terminal including a signal base that is held in the housing and is surrounded by the ground base while being insulated from the ground base, and a first signal connection part that extends from the signal base toward the first end of the housing and is to be connected to a signal line of the pin having the coaxial cable, and a second signal connection part that is disposed between the pair of second ground connection parts, extends from the signal base along the pair of second ground connection parts toward the second end of the housing, and is configured to bend when the housing is attached to the printed circuit board and the second signal connection part is connected to the signal line of the printed circuit board, wherein the housing is attached to the printed circuit board along an edge of the printed circuit board such that the pair of second ground connection parts and the second signal connection part extend outward from an edge of the housing along the surface of the printed circuit board; and wherein the second signal connection part and the pair of second ground connection parts form a coplanar line.

2. The electrical connector as claimed in claim 1, wherein the second signal connection part and the pair of second ground connection parts are comprised of spring-like parts that are configured such that when the housing is attached to the surface of the printed circuit board, natural lengths of the spring-like parts are reduced in a thickness direction of the printed circuit board.

3. The electrical connector as claimed in claim 1, wherein the housing includes a through hole that passes through the housing in a direction intersecting with a line connecting the first end and the second end and into which a component for attaching the housing to the printed circuit board is inserted.

* * * * *